United States Patent [19]

Dozier et al.

[11] 4,319,878

[45] Mar. 16, 1982

[54] METHOD AND APPARATUS FOR FORMING A REINFORCED HALF-SLOTTED CONTAINER

[75] Inventors: Henry L. Dozier, Brandon; John C. Williamson, Sessner, both of Fla.

[73] Assignee: Weyerhaeuser Company, Tacoma, Wash.

[21] Appl. No.: 76,640

[22] Filed: Sep. 18, 1979

[51] Int. Cl.[3] ..... B31B 1/36; B31B 1/54

[52] U.S. Cl. ..... 493/131; 493/177; 493/179; 493/295

[58] Field of Search ..... 93/49 R, 49 M, 52, 36.6, 93/48, 45; 493/177, 183, 437, 436, 419, 421, 131, 130, 295, 179

[56] References Cited

U.S. PATENT DOCUMENTS

| | | | |
|---|---|---|---|
| 2,220,388 | 11/1940 | Beaman et al. | 229/37 |
| 2,554,677 | 5/1951 | Michetti | 229/35 |
| 2,647,447 | 8/1953 | Andre | 93/49 R |
| 2,775,923 | 1/1957 | Ellinger | 93/49 R |
| 2,969,719 | 1/1961 | Shenigo | 93/49 R |
| 3,013,477 | 12/1961 | Meyer | 93/49 R |
| 3,063,615 | 11/1962 | Bronte et al. | 229/23 |
| 3,178,093 | 4/1965 | Wasyluka | 229/37 |
| 3,884,130 | 5/1975 | Stolkin et al. | 93/49 R |
| 4,012,996 | 3/1977 | Stolkin et al. | 93/49 R X |

*Primary Examiner*—James F. Coan

[57] ABSTRACT

A method and apparatus for forming a reinforced half-slotted container in which each of the side walls is formed by outer side wall and a reinforcing panel which is the same size and height as the outer side wall. The reinforcing panel is attached to the outer side wall along a score line at the top of the outer side wall.

In the method, either the two interior reinforcing panels or the two exterior reinforcing panels are adhered to their outer side walls and then the other two reinforcing panels are adhered to their outer side walls. The container is then formed in the normal manner to fasten the glue joint to the opposite side wall.

The apparatus has a first forming station in which the interior reinforcing panels are glued, folded over and adhered to the outer side walls, and a second forming station in which the exterior reinforcing panels are glued, folded over and adhered to the outer side walls. In the first forming station, the conveyors and hold down means act against the exterior panels and walls, and in the second forming station the conveyors and hold down means act against the interior panels. The reinforcing panels are the leading panels through the apparatus. The device for folding the reinforcing panels back upon the outer side walls is a simple spring mounted arm and detent. The order of the forming station may be reversed.

20 Claims, 9 Drawing Figures

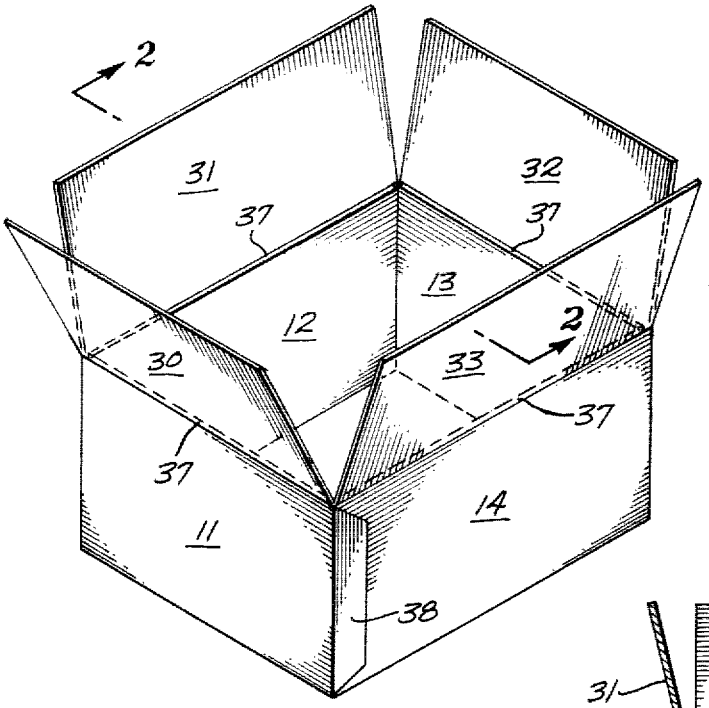
Fig. 1
Fig. 2
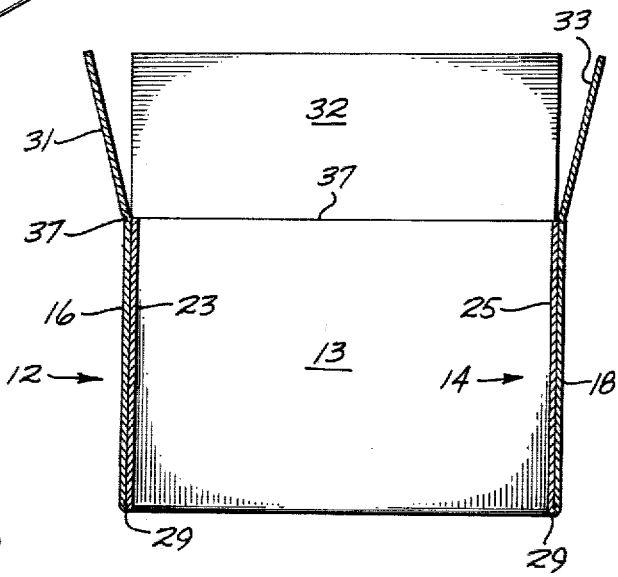
Fig. 7
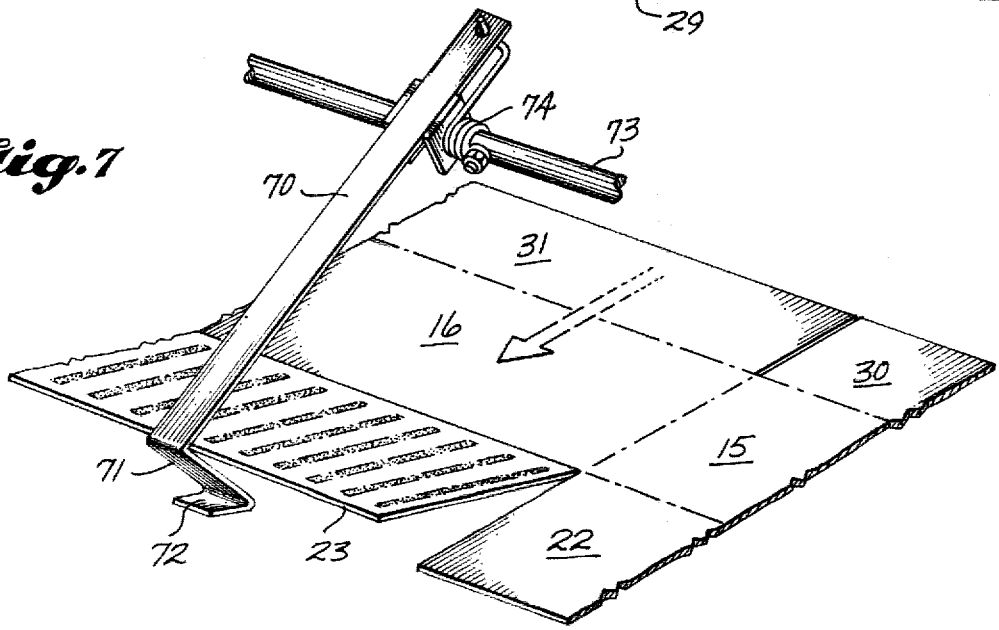

METHOD AND APPARATUS FOR FORMING A REINFORCED HALF-SLOTTED CONTAINER

BACKGROUND OF THE INVENTION

1. Field of the Invention

A method and apparatus for forming a container.

2. Description of the Prior Art

Stolkin et al., U.S. Pat. Nos. 3,884,130 and 4,012,996, disclose apparatus for folding back the flaps forming the bottom of a container and adhering these flaps together to form a self opening container. The device for placing glue on the flaps and folding back the bottom flaps is shown in U.S. Pat. No. 3,884,130. All of the bottom flaps are folded over together. The apparatus for folding the exterior side walls onto the interior side walls is shown in U.S. Pat. No. 4,012,996.

Beaman, et al., U.S. Pat. No. 2,220,388, have an upper flange formed by extensions of the side walls which are folded down to overlie the upper edge of the side walls.

Wasyluka, U.S. Pat. No. 3,178,093, discloses a container in which an upper flange is formed by a number of panels which extend upwardly from the side walls and are folded around the upper edge of the side walls.

Bronte, et al., U.S. Pat. No. 3,063,615, also disclose a container having an upper flange reinforcement.

SUMMARY OF THE INVENTION

A method and apparatus has been devised for forming a reinforced half slotted container in a very simple manner with little change to existing equipment. The reinforced container has side wals formed by an outer side wall and a reinforcing panel attached to the outer side wall along a score line at the upper edge of the outer side wall. The reinforcing panel is the same size as the outer side wall.

The reinforcing panels are the leading panels through the process and are adhered to the outer side walls in pairs; an interior pair and an exterior pair. In the method, glue is applied to the interior panels, either the reinforcing panels or the outer side walls. The reinforcing panels are folded over onto the outer side walls and adhered to them. The process is repeated for the exterior panels. The order may be reversed.

The apparatus has a first forming station in which the interior reinforcing panels are glued, folded over and adhered to the outer side walls, and a second forming station in which the exterior reinforcing panels are glued, folded over and adhered to the outer side walls. In the first forming station the conveyors and hold down means act against the exterior panels and walls, and in the second forming station, the conveyors and hold down means act against the interior panels. The reinforcing panels are the leading panels through the apparatus. The device for folding the reinforcing panels back upon the outer side walls is a simple spring mounted arm and detent. Again, the order of the forming stations may be reversed.

BRIEF DESCRIPTION OF THE DRAWINGS

FIG. 1 is an isometric view of the container.

FIG. 2 is a cross section of the container taken along line 2—2 of FIG. 1.

FIG. 7 is a plan view of the device used for folding the reinforcing flaps over the outer side walls.

DESCRIPTION OF THE PREFERRED EMBODIMENTS

Figure 3:
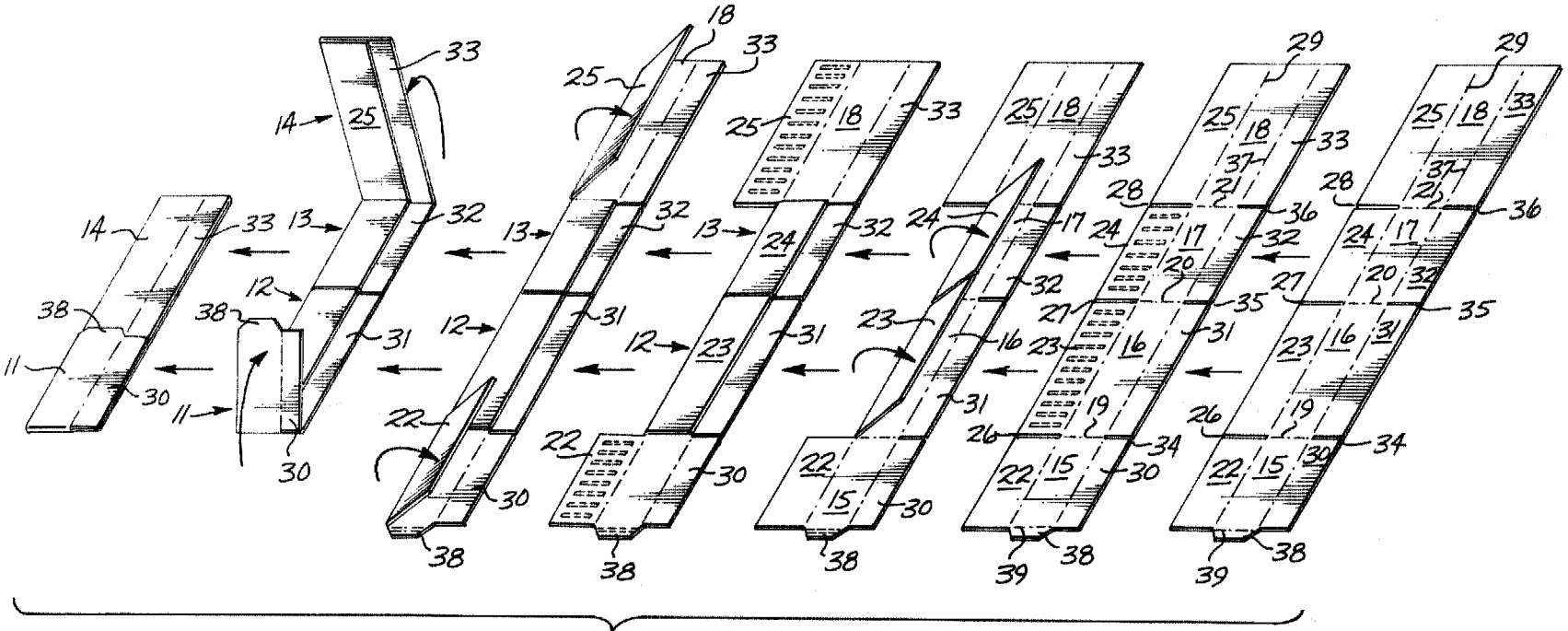
FIG. 3 is an isometric view of the flow of the container through the process showing the container being formed.
Figure 4:
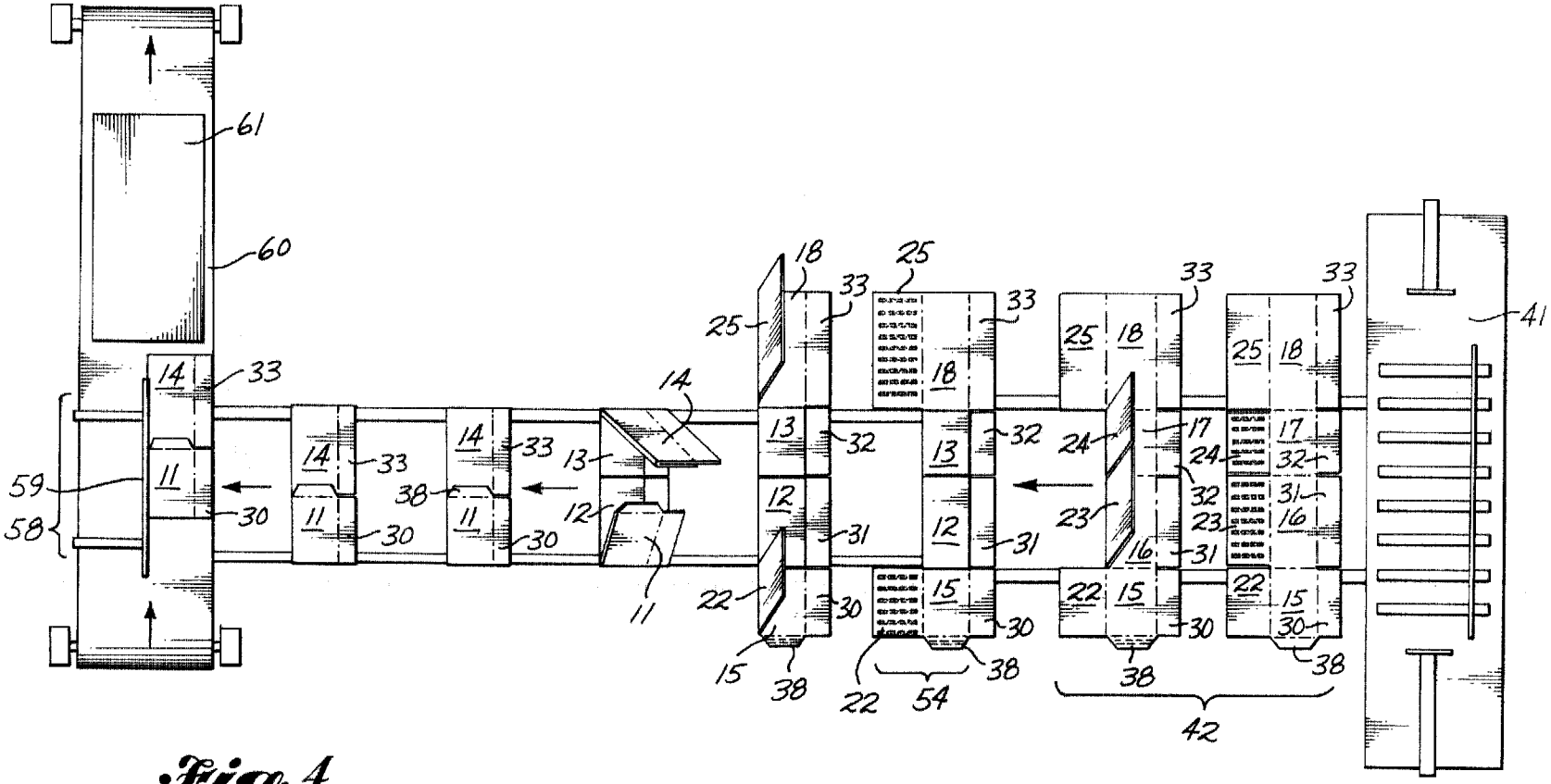
FIG. 4 is a top plan view of the apparatus and shows the container passing through the forming stations.

The container 10 has side walls 11, 12, 13 and 14. Each of these side walls is formed by an outer side wall and a reinforcing panel adhered to the outer side wall.

The outer side walls 15, 16, 17 and 18 are joined by score lines 19, 20 and 21 and the reinforcing panels 22, 23, 24 and 25 are separated by slots 26, 27 and 28 and each panel is attachedto its outer side wall along score line 29. In the finished container each of the reinforcing panels is bent around score line 29 and adhered to its outer side wall to form the reinforced side wall.

The bottom closure panels 30, 31, 32 and 33 are also separated by slots 34, 35 and 36 and attached to outer side walls along score line 37.

The panel 38 is attached to outeer side wall 15 along score line 39 and in the finished container is adhered to the outer edge of outer side wall 18 of side wall 14.

The reinforcing panels are of approximately the same size and of the same height as the outer side walls and provide additional support to the side walls because they extend to the bottom wall.

The container is formed by first placing glue on reinforcing panels 23 and 24 and folding them around score line 29 and adhering them to outer side walls 16 and 17 respectively. Glue is then placed on reinforcing panels 22 and 25 and the panel 38. The reinforcing panels are then folded around the score line 29 and adhered to outer side walls 15 and 18 respectively.

The side walls 11 and 14 are next folded around score lines 19 and 21 respectively with the panel 38 overlying the outer edge of side wall 14. The panel 38 is then adhered to the side wall to form the four sides of the container.

Figure 5A:
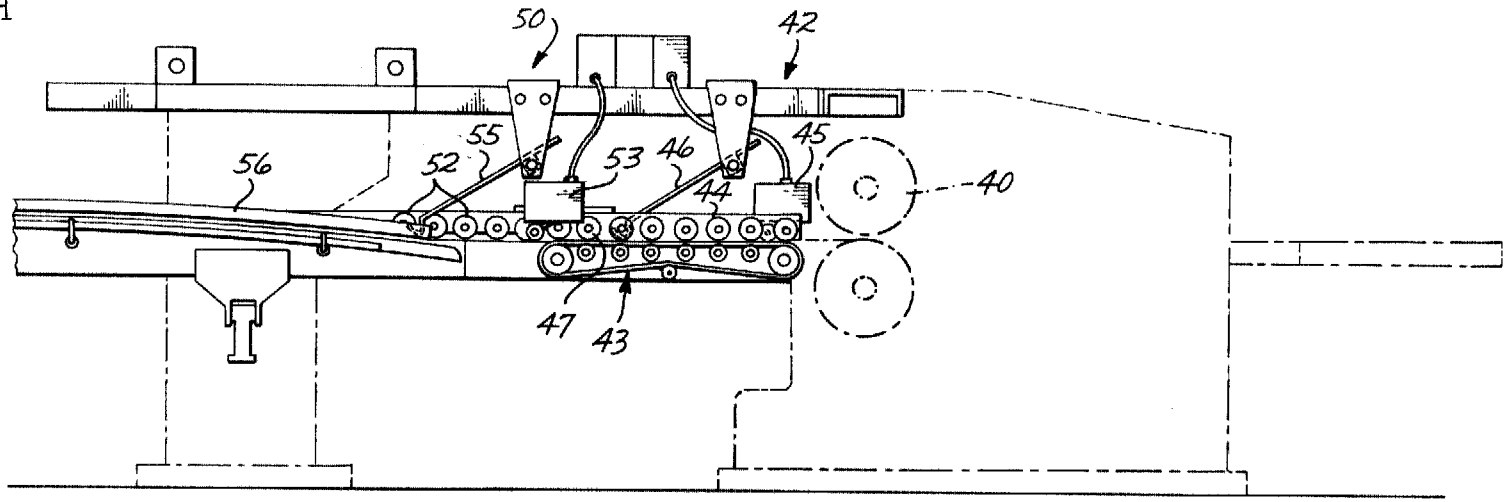
FIGS. 5A and 5B are a side plan view of the apparatus for forming the container.
Figure 6A:
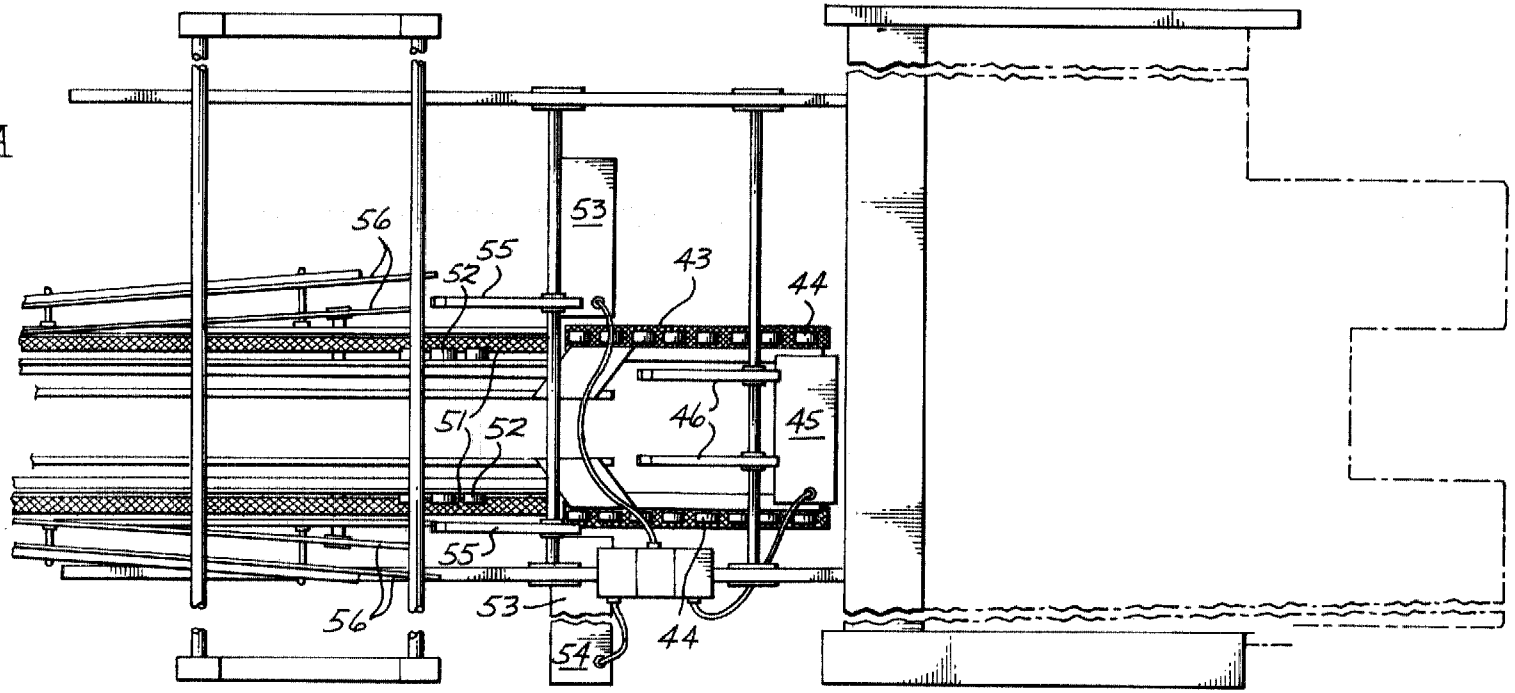
FIGS. 6A and 6B are a top plan view of the apparatus.
Figure 5B:
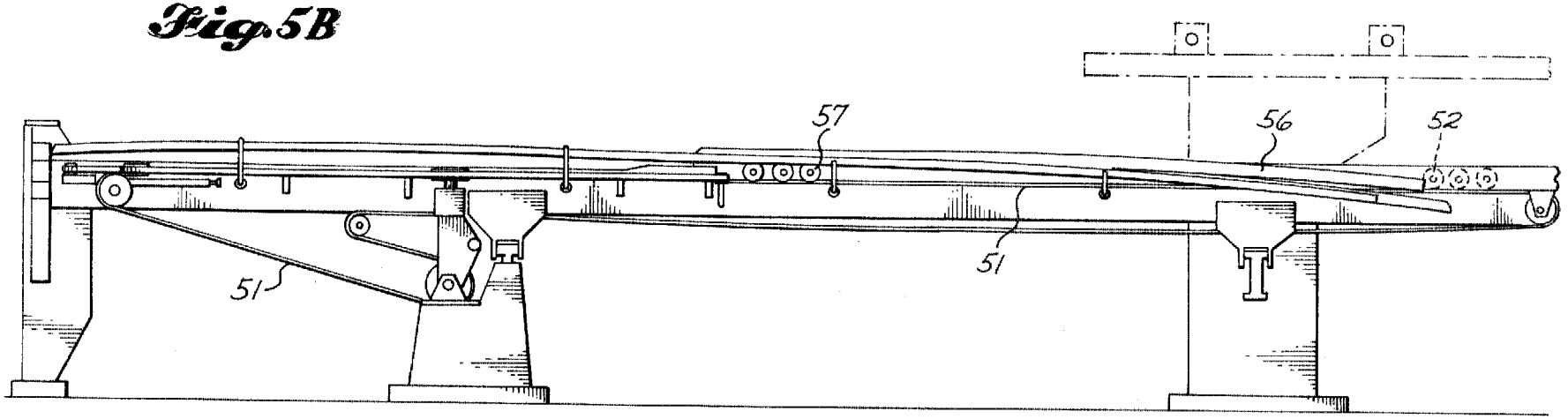
Figure 6B:
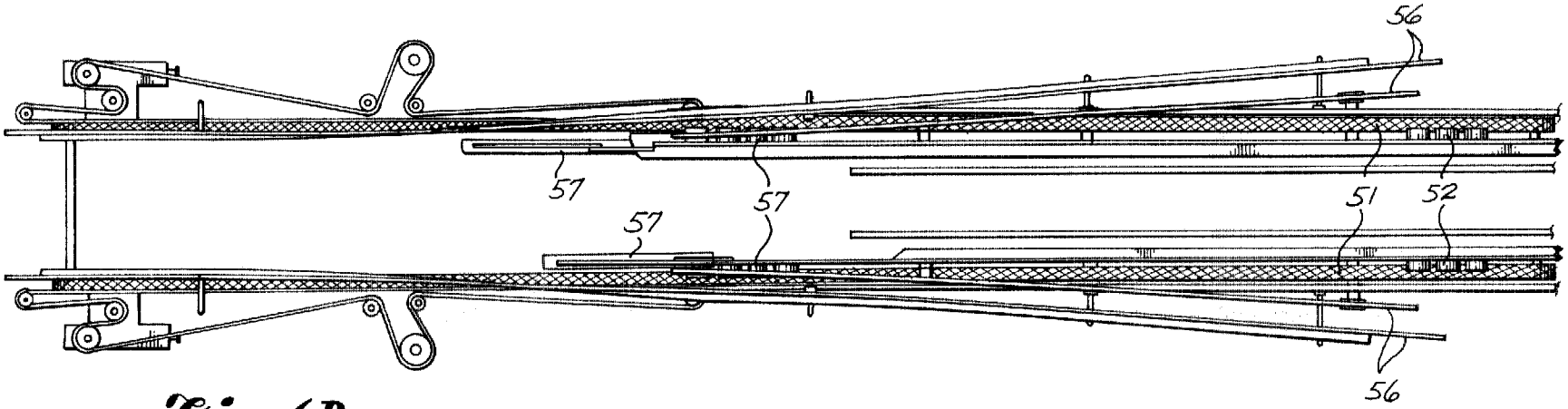

The apparatus to perform this process is shown in FIG. 5. The conveyor of feed rolls 40 on feed table 41 pushes the blank into the first forming station 42. The reinforcing panels are the leading panels into the forming process. Conveyors 43 for the outlying panels carry the blank through this forming station. These conveyors are below the hold down bars or rollers 44 which are outward of score lines 19 and 21 and their respective slots 26 and 34 and 28 and 36. Gluing means 45 places glue on the upper faces of either the reinforcing flaps 23 and 24 or the outer side walls 16 and 17. The reinforcing flaps 23 and 24 are then folded over onto the outer side walls 16 and 17 by folding means 46 and are adhered to the outer side walls by the compression rolls 47.

The containers are transferred from the first forming station 42 to the second forming station 50 and are moved through the second forming station by a conveyor 51 which carries the interior side walls 12 and 13 through the process. In the second forming station the hold down bars or rolls 52 overlie the side walls 12 and 13 and the conveyor 51. They are shown as extensions of the compression rolls 47.

In this forming station glue means 53 places glue on the upper faces of either the reinforcing flaps 22 and 25 or the outer side walls 15 and 18 and glue means 54 places glue on the panel 38. Folding means 55 then folds the reinforcing panels 22 and 25 over the outer side walls 15 and 18 and applies pressure to adhere the reinforcing panels to the outer side walls to form side walls 11 and 14.

The blank is now carried through the next forming operation in which the exterior side walls 11 and 14 are folded over the interior side walls 12 and 13. The folding means or guides 56 fold the two exterior side walls around score lines 19 and 21 over the interior side walls 12 and 13. The side wall 14 is folded down before the side wall 11 so that the panel 38 will overlie the outer edge of side wall 14. The hold down shoes 57 are spaced from and extensions of hold down means 52.

The blank is carried into squaring station 58 in which the walls are squared by being pushed against a squaring edge 59.

A conveyor 60 carries the blank sideways into a compressor station 61 in which pressure is applied to finally glue to container together.

Folding and adhering the inner reinforcing panels and then the outer reinforcing panels means that there need be only one change in the location of the hold down means during the folding operation. It should be understood that the second forming station can be split into two sections if it is desired to adhere the outer reinforcing panels 22 and 25 before the inner reinforcing panels 23 and 24. In this instance the hold down means would first be within score lines 19 and 21, then outside of score lines 19 and 21 and then back inside score lines 19 and 21 for the last folding operation of the outer side walls 11 and 14 over the inner side walls 12 and 13.

The glue means 45 and 53 would normally be glue spray heads which would be actuated by the passage of the blank beneath the glue station. A Valco glue system, which uses glue heads of varying sizes to spray glue onto blanks, could be used for this installation.

The folding means 45 and 55 are shown in FIG. 7. The device is mounted above the conveyor and has a straight arm 70 with a detent 71 at approximately right angles to the arm. At the end of the detent is a pressure member 72 which would ride on top of the blank. The entire mechanism is mounted on a shaft 73 and is biased by spring 74 downwardly against the blank. As the blank moves forwardly, the front edge of the reinforcing panel is caught by the detent 71. The forward motion of the blank causes the reinforcing panel to fold upwardly around the score line 29. As the score line moves beneath the detent, the spring causes the arm to force the reinforcing panel down onto the outer sidewall and provide pressure on the reinforcing panel to adhere it to the outer sidewall.

The adhesive may be applied to both the reinforcing panel and outer side wall if desired.

What is claimed is:

1. A method of forming a reinforced half slotted container from a container blank in which each of the side walls is formed by an outer side wall and a reinforcing panel attached to said outer side wall along a score line at the top of said outer side wall, said panels and outer side walls comprising an exterior pair along the side edges of said blank and an interior pair of panels and walls between said exterior pair, comprising applying adhesive to one of said reinforcing panels or said outer side walls of one of said exterior or interior pairs of panels, folding said reinforcing panels of said one pair onto said outer side wall with said adhesive between said reinforcing panels and said outer side walls and adhering said reinforcing panels to said outer side walls, applying adhesive to one of said reinforcing panels or outer side walls of said other pair of said interior or exterior pairs of panels, folding said reinforcing panels of said other pair onto said outer side walls with said adhesive between said reinforcing panels and said outer side walls, and adhering said reinforcing panels to said outer side walls.

2. The method of claim 1 in which said one pair of panels is said interior pairs of panels and said other pair of panels is said exterior pairs of panels.

3. The method of claims 1 or 2 in which one of said exterior outer side walls has a glue panel along its outer side edge which is adhered to the outer side edge of said other exterior outer side wall, further comprising folding said exterior side walls over said interior side walls and adhering said glue panel to said other exterior outer side wall.

4. A method of forming a reinforced half slotted container from a container blank in which each of the side walls is formed by an outer side wall and a reinforcing panel attached to said outer side wall along a score line at the top of said outer side wall, said panels and outer side walls comprising an exterior pair along the side edges of said blank and an interior pair of panels and walls between said exterior pair, comprising applying adhesive to said reinforcing panels and said outer side walls of one of said exterior or interior pairs of panels, folding said reinforcing panels of said one pair onto said outer side wall with said adhesive between said reinforcing panels and said outer side walls and adhering said reinforcing panels to said outer side walls, applying adhesive to said reinforcing panels and outer side walls of said other pair of said interior or exterior pairs of panels, folding said reinforcing panels of said other pair onto said outer side walls with said adhesive between said reinforcing panels and said outer side walls, and adhering said reinforcing panels to said outer side walls.

5. The method of claim 4 in which said one pair of panels is said interior pairs of panels and said other pair of panels is said exterior pairs of panels.

6. The method of claims 4 or 5 in which one of said exterior outer side walls has a glue panel along its outer side edge which is adhered to the outer side edge of said other exterior outer side wall, further comprising folding said exterior side walls over said interior side walls and adhering said glue panel to said other exterior outer side wall.

7. In the method of forming a half slotted container from a container blank in which said blank has a pair of exterior side walls along the side edges of the container blank and a pair of interior side walls between said exterior side walls, and one of said exterior side walls has a glue flap along one side edge which is adhered to the outer side edge of said other exterior side wall, comprising folding the exterior side walls over the interior side walls and said glue flap over the other exterior side wall and adhering the glue flap to the other exterior side wall, the improvement comprising said container having reinforced side walls formed by reinforcing panels attached along score lines to the upper edges of said side walls and adhered to said side walls, comprising placing glue on one of said reinforcing panels or side walls of one of said exterior or interior pairs of panels, folding said reinforcing panels over said side walls and adhering said reinforcing panels to said side walls, placing glue on one of said side walls or reinforcing panels of said other of said exterior or interior pairs of panels, and folding said reinforcing panels over said side walls and adhering them to said side walls.

8. The method of claim 7 in which said one pair of panels is said interior pairs of panels and said other pair of panels is said exterior pairs of panels.

9. In the method of forming a half slotted container from a container blank in which said blank has a pair of exterior side walls along the side edges of the container blank and a pair of interior side walls between said exterior side walls and one of said exterior side walls has a glue flap along one side edge which is adhered to the outer side edge of said other exterior side wall, comprising folding the exterior side walls over the interior side walls and said glue flap over the other exterior side wall and adhering the glue flap to the other exterior side wall, the improvement comprising said container having reinforced side walls formed by reinforcing panels attached along score lines to the upper edges of said side walls and adhered to said side walls, comprising placing glue on said reinforcing panels and side walls of one of said exterior or interior pairs or panels, folding said reinforcing panels over said side walls and adhering said reinforcing panels to said side walls, placing glue on said side walls and reinforcing panels of said other of said exterior or interior pairs of panels, and folding said reinforcing panels over said side walls and adhering them to said side walls.

10. The method of claim 9 in which said one pair of panels is said interior pairs of panels and said other pair of panels is said exterior pairs of panels.

11. An apparatus for forming a reinforced half slotted container from a container blank in which said container has side walls formed by outer side walls and reinforcing panels attached to said outer side walls along a score line on the top edge of each of said outer side walls, said outer side walls and said reinforcing panels being divided into an exterior pair of panels along the outer side edges of said blank and an interior pair of panels between said exterior pair of panels, said apparatus comprising a first forming station for adhering the reinforcing panels to the outer side walls of one of said pairs of exterior or interior pairs of panels, said first forming station comprising means acting upon said other pair of said pairs of panels for conveying said blank through said first forming station, hold down means acting upon said other pair of said pairs of panels for holding said panels against said conveyor and preventing their upward movement, means for applying adhesive to one of said reinforcing panels or said outer side walls to said one pair of said pairs of panels, means for folding said reinforcing panels back upon said outer side walls and adhering said reinforcing panels to said outer side walls, a second forming station in which said reinforcing panels are adhered to said outer side walls of said other pair of said pairs of panels, said second forming station comprising means acting upon said one pair of panels for carrying said blank through said forming station, hold down means for holding said one pair of panels against said conveying means and preventing said one pair of panels from moving upwardly, means for applying adhesive to one of said reinforcing panels or said outer side walls of said other pair of said pairs of panels, means for folding said reinforcing panels over and adhering them to said outer side walls,

12. The apparatus of claim 11 in which said one pair of panels is said interior pairs of panels and said other pair of panels is said exterior pairs of panels.

13. The apparatus of claims 11 or 12 in which one of said exterior side walls has a glue flap along one edge which would adhere to the outer edge of said other exterior outer side wall, further comprising means for placing glue on said glue panel, means for folding said exterior panels over said interior panels and adhering said glue panel to said other outer side wall.

14. An apparatus for forming a reinforced half slotted container from a container blank in which said container has side walls formed by outer side walls and reinforcing panels attached to said outer side walls along a score line on the top edge of each of said outer side walls, said outer side walls and said reinforcing panels being divided into an exterior pair of panels along the outer side edges of said blank and an interior pair of panels between said exterior pair of panels, said apparatus comprising a first forming station for adhering the reinforcing panels to the outer side walls of one of said pairs of exterior or interior pairs of panels, said first forming station comprising means acting upon said other pair of said pairs of panels for conveying said blank through said first forming station, hold down means acting upon said other pair of said pairs of panels for holding said panels against said conveyor and preventing their upward movement, means for applying adhesive to said reinforcing panels and said outer side walls of said one pair of said pairs of panels, means for folding said reinforcing panels back upon said outer side walls and adhering said reinforcing panels to said outer side walls, a second forming station in which said reinforcing panels are adhered to said outer side walls of said other pair of said pairs of panels, said second forming station comprising means acting upon said one pair of panels for carrying said blank through said forming station, hold down means for holding said one pair of panels against said conveying means and preventing said one pair of panels from moving upwardly, means for applying adhesive to said reinforcing panels and said outer side walls of said other pair of said pairs of panels, means for folding said reinforcing panels over and adhering them to said outer side walls,

15. The apparatus of claim 14 in which said one pair of panels is said interior pairs of panels and said other pair of panels is said exterior pairs of panels.

16. The apparatus of claims 14 or 15 in which one of said exterior side walls has a glue flap along one edge which would adhere to the outer edge of said other exterior outer side wall, further comprising means for placing glue on said glue panel, means for folding said exterior panels over said interior panels and adhering said glue panel to said other outer side wall.

17. In an apparatus for forming a half slotted container from a container blank in which said blank has a pair of exterior side walls along the side edges of the container blank and a pair of interior side walls between said exterior side walls and one of said exterior side walls has a glue flap along one side edge which is adhered to the outer side edge of said other exterior side wall, comprising means for placing glue on said glue panel, means for folding said exterior panels over said interior panels and adhering said glue panel to said other outer side wall, the improvement comprising said container having reinforced side walls formed by reinforcing panels attached along score lines to the upper edges of said side walls and adhered to said side walls, comprising a first forming station for adhering the reinforcing panels to the outer side walls of one of said pairs of exterior or interior pairs of panels, said first forming station comprising means acting upon said other pair of said pairs of panels for conveying said blank through said first forming station, hold down means acting upon said other pair of said pairs of panels for holding said panels against said conveyor and preventing their upward movement, means for applying adhesive to one of said reinforcing panels or said outer side walls of said one pair of said pairs of panels, means for folding said reinforcing panels back upon said outer side walls and adhering said reinforcing panels to said outer side walls, a second forming station in which said reinforcing panels are adhered to said outer side walls of said other pair of said pairs of panels, said second forming station comprising means acting upon said one pair of panels for carrying said blank through said forming station, hold down means for holding said one pair of panels against said conveying means and preventing said one pair of panels from moving upwardly, means for applying adhesive to one of said reinforcing panels or said outer side wals of said other pair of said pairs of panels, means for folding said reinforcing panels over and adhering them to said outer side wall.

18. The apparatus of claim 17 in which said one pair of panels is said interior pairs of panels and said other pair of panels is said exterior pairs of panels.

19. In an apparatus for forming a half slotted container from a container blank in which said blank has a pair of exterior side walls along the side edges of the container blank and a pair of interior side walls between said exterior side walls and one of said exterior side walls has a glue flap along one side edge which is adhered to the outer side edge of said other exterior side wall, comprising means for placing glue on said glue panel, means for folding said exterior panels over said interior panels and adhering said glue panel to said other outer side wall, the improvement comprising said container having reinforced side walls formed by reinforcing panels attached along score lines to the upper edges of said side walls and adhered to said side walls, comprising a first forming station for adhering the reinforcing panels to the outer side walls of one of said pairs of exterior or interior pairs of panels, said first forming station comprising means acting upon said other pair of said pairs of panels for conveying said blank through said first forming station, hold down means acting upon said other pair of said pairs of panels for holding said panels against said conveyor and preventing their upward movement, means for applying adhesive to said reinforcing panels and said outer side walls of said one pair of said pairs of panels, means for folding said reinforcing panels back upon said outer side walls and adhering said reinforcing panels to said outer side walls, a second forming station in which said reinforcing panels are adhered to said outer side walls of said other pair of said pairs of panels, said second forming station comprising means acting upon said one pair of panels for carrying said blank through said forming station, hold down means for holding said one pair of panels against said conveying means and preventing said one pair of panels from moving upwardly, means for applying adhesive to said reinforcing panels and said outer side walls of said other pair of said pairs of panels, means for folding said reinforcing panels over and adhering them to said outer side wall.

20. The apparatus of claim 19 in which said one pair of panels is said interior pairs of panels and said other pair of panels is said exterior pairs of panels.

* * * * *